US010132171B2

(12) United States Patent
Locatelli et al.

(10) Patent No.: US 10,132,171 B2
(45) Date of Patent: Nov. 20, 2018

(54) ROTOR DISK BLADE WITH FRICTION-HELD ROOT, ROTOR DISK, TURBOMACHINE AND ASSOCIATED ASSEMBLY METHOD

(71) Applicants: SAFRAN CERAMICS, Le Haillan (FR); SAFRAN AIRCRAFT ENGINES, Paris (FR)

(72) Inventors: David Locatelli, Eysines (FR); Clement Roussille, Bordeaux (FR); Ivan Herraiz, Pau (FR)

(73) Assignees: SAFRAN CERAMICS, Le Haillan (FR); SAFRAN AIRCRAFT ENGINES, Paris (FR)

( * ) Notice: Subject to any disclaimer, the term of this patent is extended or adjusted under 35 U.S.C. 154(b) by 203 days.

(21) Appl. No.: 14/893,744

(22) PCT Filed: May 26, 2014

(86) PCT No.: PCT/FR2014/051231
§ 371 (c)(1),
(2) Date: Nov. 24, 2015

(87) PCT Pub. No.: WO2014/191670
PCT Pub. Date: Dec. 4, 2014

(65) Prior Publication Data

US 2016/0108744 A1 Apr. 21, 2016

(30) Foreign Application Priority Data

May 28, 2013 (FR) ..... 13 54797

(51) Int. Cl.
*F01D 5/30* (2006.01)
*F01D 5/14* (2006.01)
*F01D 5/28* (2006.01)

(52) U.S. Cl.
CPC ..... *F01D 5/3015* (2013.01); *F01D 5/147* (2013.01); *F01D 5/282* (2013.01); *F01D 5/3007* (2013.01);
(Continued)

(58) Field of Classification Search
CPC ..... F05D 5/3015; F05D 5/147; F05D 5/282; F05D 5/3007; F05D 2250/232; F05D 2250/294; F05D 2250/61; F05D 2260/37
(Continued)

(56) References Cited

U.S. PATENT DOCUMENTS 1,669,388 A * 5/1928 Chapman ..... B25G 1/00 279/96
2,684,831 A * 7/1954 Cyril ..... F01D 5/021 416/214 A
(Continued)

FOREIGN PATENT DOCUMENTS

EP 2 374 999 10/2011

OTHER PUBLICATIONS

Thermal expansion of some nickel alloys.*
Guide to Design Criteria for Bolted and Riveted Joints.*
International Search Report dated Jul. 23, 2014 in PCT/FR14/051231 Filed May 26, 2014.

*Primary Examiner* — Logan Kraft
*Assistant Examiner* — Brian Delrue
(74) *Attorney, Agent, or Firm* — Oblon, McClelland, Maier & Neustadt, L.L.P.

(57) ABSTRACT

A rotor disk blade for a turbine engine, the blade being made of composite material including fiber reinforcement obtained by multilayer weaving of yarns and densified by a matrix. The blade has a portion constituting an airfoil and a blade root forming a single piece, the blade root having two substantially plane opposite lateral flanks that are formed respectively extending the pressure side surface and the suction side surface of the airfoil. The blade root is clamped
(Continued)

between two metal plates fastened against the lateral flanks of the blade root by a bolt and a nut passing through the plates and the blade root. The bolt has a head bearing against one of the two plates. The nut has a head bearing against the other plate.

17 Claims, 4 Drawing Sheets

(52) U.S. Cl.
CPC .. *F05D 2250/232* (2013.01); *F05D 2250/294* (2013.01); *F05D 2250/61* (2013.01); *F05D 2260/37* (2013.01)

(58) Field of Classification Search
USPC ..... 416/220
See application file for complete search history.

(56) References Cited

U.S. PATENT DOCUMENTS

| | | | | |
|---|---|---|---|---|
| 2,949,278 | A * | 8/1960 | McCormick | F01D 5/326 416/193 A |
| 2004/0247835 | A1* | 12/2004 | Keener | B05D 7/16 428/160 |
| 2010/0061858 | A1* | 3/2010 | Jones | F04D 29/023 416/204 R |
| 2010/0189562 | A1 | 7/2010 | Blanchard et al. | |
| 2011/0243746 | A1 | 10/2011 | Liotta et al. | |
| 2016/0137559 | A1* | 5/2016 | Chamberlain | C04B 41/88 428/454 |

* cited by examiner

ROTOR DISK BLADE WITH FRICTION-HELD ROOT, ROTOR DISK, TURBOMACHINE AND ASSOCIATED ASSEMBLY METHOD

BACKGROUND OF THE INVENTION

The present invention relates to the general field of turbine engine blades made of composite material comprising fiber reinforcement densified by a matrix.

The intended field is that of rotor blades for assembling on gas turbine rotor disks for aeroengines or industrial turbines.

This type of blade was originally made by casting and included a root in the shape of a bulb. The as-cast root was subjected to precision machining in order to provide an effective mechanical interface with its housing in the rotor disk.

Proposals have already been made to fabricate similar turbine engine blades out of composite materials. By way of example, reference may be made to patent application US 2011/311368, which describes fabricating a turbine engine blade by making an airfoil preform by three-dimensional or multilayer weaving and then by densifying the preform with a matrix. The root of the composite material blade reproduces the bulb shape so as to take up centrifugal force and facilitate incorporating composite material blades in an existing engine environment.

For blades made of composite material, the blade root is made by using an insert that is positioned in a region of non-interlinking in the textile preform so as to form a bulb-shaped portion in that part of the blade that corresponds to its root.

Nevertheless, that technique of forming a blade root makes industrial fabrication of the blade more complex and increases its fabrication cost, since it leads to considerable losses of material and requires difficult handling that slows down the speed of production. Furthermore, the insert which is also made of composite material needs to be densified and machined, thereby leading to additional costs and possibly to parts being rejected.

The textile of the preform, which is naturally floppy, interacts mechanically with the insert and can lead in particular to textile shear, to the insert turning, to interlinking being lost between the insert and the textile, etc.

Furthermore, molding and densifying the portion of the preform that is to form the blade root are found to be difficult, in particular because the tolerances on the profile of the bulb-shaped root are very small (of the order of one-tenth of a millimeter) and because requirements in terms of mechanical properties for this portion of the blade are significant, since the blade root concentrates the majority of the forces that are applied to the blade.

Document US 2010/189562 discloses a turbine engine blade made of composite material having a substantially plane portion in its part that is to form the blade root, the root shape being obtained by clamping this portion between two metal plates that are held in place by a welded stud. That design makes it possible to facilitate fabricating the blade out of composite material, since the root geometry of bulb or equivalent shape that is difficult to obtain from the textile preform is provided by adding metal plates against the flanks of a plane portion, which is simple to make out of composite material.

Nevertheless, as mentioned above, the root of a blade corresponds to the portion of the blade that concentrates most of the forces applied to the blade, since it serves to hold the blade in the disk against centrifugal forces. When the metal plates are held by a welded stud, as described in Document US 2010/189562, the forces applied by centrifugal force are taken up essentially via that portion of the composite material of the blade which is in contact with the stud, whenever the friction forces between the metal plates and the flanks of the blade made of composite material are not sufficient for taking up those forces. That situation therefore leads to a risk of the composite material being damaged, or indeed of it being ruptured or crushed.

OBJECT AND SUMMARY OF THE INVENTION

A main object of the present invention is thus to propose a blade made of composite material in which the shape of the root can be achieved in a manner that is easy and reproducible, while nevertheless reliably taking up the forces that are applied to the blade root.

This object is achieved by a rotor disk blade for a turbine engine, the blade being made of composite material comprising fiber reinforcement obtained by multilayer weaving of yarns and densified by a matrix, the blade having a portion constituting an airfoil and a blade root forming a single piece, the blade root having two substantially plane opposite lateral flanks that are formed respectively extending the pressure side surface and the suction side surface of the airfoil, the blade root being clamped between two metal plates fastened against the lateral flanks of the blade root by a bolt and a nut passing through the plates and the blade root, the blade being characterized in that the bolt has a head bearing against one of the two plates and in that the nut has a head bearing against the other plate, the bolt and the nut applying some minimum level of clamping force against the two metal plates for ensuring that a determined centrifugal force applied to the blade is taken up by friction between the metal plates and the lateral flanks of the blade root.

By clamping the plates to ensure non-sliding contact between the plates and the flanks of the blade root, centrifugal force (traction force) is taken up at the blade root in a manner that is distributed over the entire contact area between the blades and the flanks of the composite material root. This avoids stresses being concentrated in the zone of contact between the fastener member between the plates and the corresponding portion of the composite material root, which can lead to damage to the root of the blade. By means of this non-sliding contact, a reduction is also obtained in sensitivity to the lack of compensation of the centrifugal moment by the aerodynamic moment of the airfoil of the blade, which can lead to the blade root tilting in the slot of the disk in which it is received.

In a first aspect of the blade of the invention, the minimum clamping force is determined by dividing the determined centrifugal force by means of the coefficient of friction between the metal plates and the lateral flanks of the blade root.

In a second aspect of the blade of the invention, the bolt and the nut have respective heads of conical shape and the plates have corresponding countersinks enabling the bolt and the nut to be fully integrated in the plates.

In a third aspect of the blade of the invention, each metal plate includes on its face opposite from its face in contact with the blade root at least one projecting portion, said projecting portion presenting a shape suitable for providing one or both of the following functions: opposing tilting and providing sealing.

In a fourth aspect of the blade of the invention, the blade root includes an oblong hole or festooning extending in the long direction of the blade for passing the bolt and the nut. The oblong hole or festooning enables thermodynamic stresses to be released.

In a fifth aspect of the blade of the invention, the face of each plate facing the blade root presents a surface that is structured so as to increase friction between the plates and the blade root. The face of each plate facing the blade root may in particular include knurling that may be straight-line knurling or cross-knurling oriented as a function of the direction of the centrifugal forces to which the blade is subjected.

In a sixth aspect of the blade of the invention, the metal plates have a coefficient of thermal expansion that is less than the coefficient of thermal expansion of the bolt and of the nut. The clamping force is thus maintained during rises in temperature.

In a seventh aspect of the blade of the invention, the metal plates, the bolt, and the nut present coefficients of thermal expansion that vary in similar manner over all or part of a temperature range extending from 0° C. to 800° C., thus achieving better control over maintaining clamping over the entire temperature range.

The invention also provides a turbine engine rotor disk including a plurality of substantially axial metal slots at its outer periphery and a plurality of blades as defined above, each blade being assembled via its root in a slot of the disk. The invention also provides a turbine engine including at least one such rotor disk.

The invention also provides a method of assembling plates on a blade root, said blade being made of a composite material comprising fiber reinforcement obtained by multi-layer weaving of yarns and densified by a matrix, the blade having a portion constituting an airfoil and a blade root forming a single piece, the blade root having two substantially plane opposite lateral flanks that are formed respectively extending the pressure side surface and the suction side surface of the airfoil, the blade root being clamped between two metal plates fastened against the lateral flanks of the blade root by a bolt and a nut passing through the plates and the blade root, the method being characterized in that the bolt has a head bearing against one of the two plates, the nut having a head bearing against the other plate, and in that when tightening the bolt with the nut, some minimum level of clamping force is applied to the metal plates to ensure that a determined centrifugal force applied to the blade is taken up by friction between the metal plates and the lateral flanks of the blade root.

As explained above, by fastening the metal plates to the blade root with non-sliding contact as a result of some minimum level of clamping force, centrifugal force (traction force) take up is spread over the total contact area at the blade root between the plates and the flanks of the composite material root. This avoids stresses becoming concentrated in the zone of contact between the fastener member of the plates and the corresponding portion of the composite material root, which can lead to damage of the blade root. By means of this non-sliding contact, a reduction is also obtained in the sensitivity to the lack of compensation of the centrifugal moment by the aerodynamic moment of the airfoil of the blade, which can lead to the blade root tilting in the slot of the disk in which it is received.

In an aspect of the method of the invention, the minimum clamping force is determined by dividing the determined centrifugal force by the coefficient of friction between the metal plates and the lateral flanks of the blade root.

BRIEF DESCRIPTION OF THE DRAWINGS

Other characteristics and advantages of the present invention appear from the following description made with reference to the accompanying drawings, which show embodiments having no limiting character. In the figures.

DETAILED DESCRIPTION OF EMBODIMENTS

Figure 1:
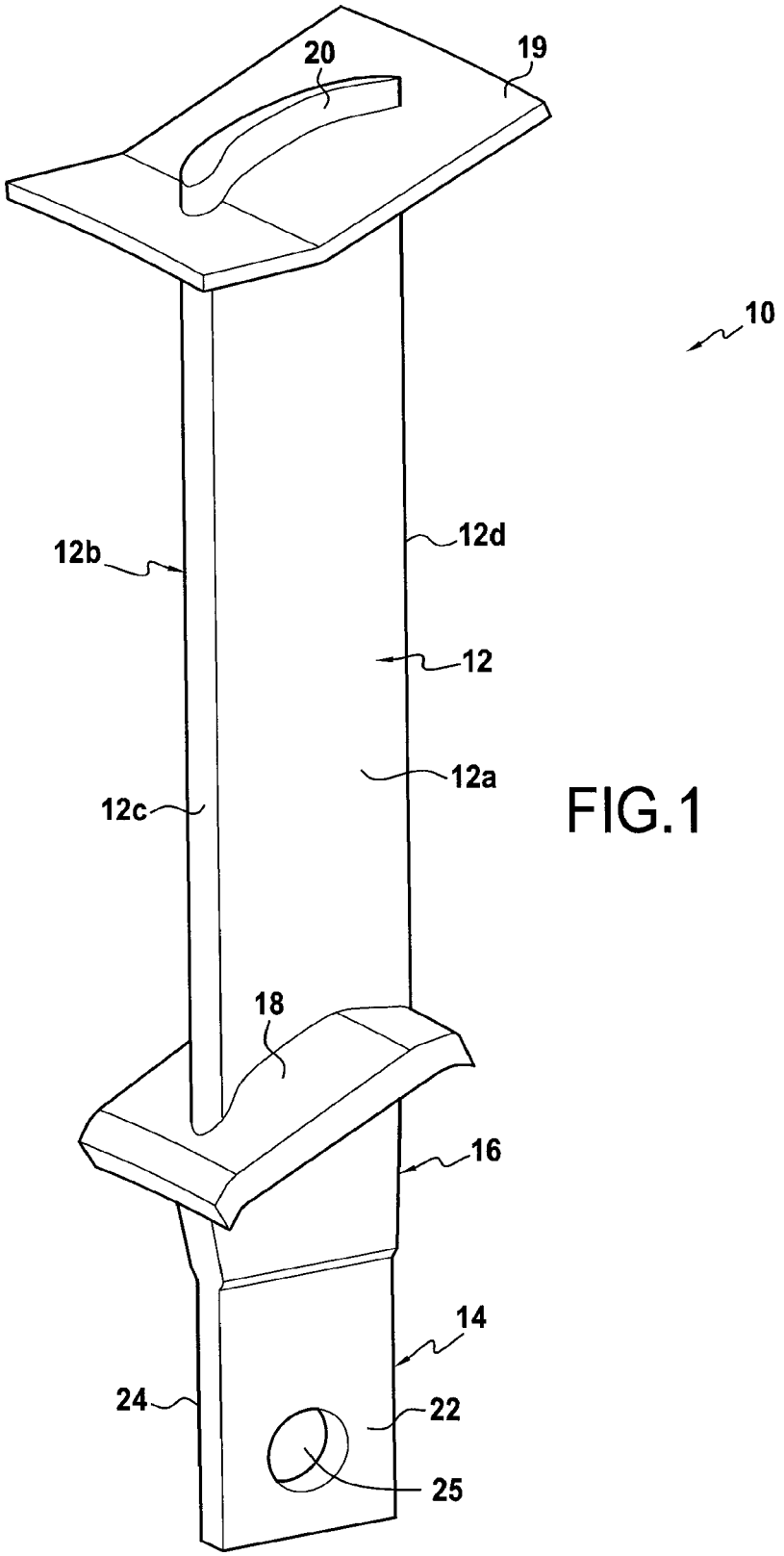
FIG. 1 is a perspective view showing a turbine engine blade in an embodiment of the invention.

The invention is applicable to various types of turbine rotor blade made of composite material, and in particular to compressor and turbine blades for various gas turbine spools, e.g. a rotor disk blade for a low pressure turbine, such as the blade shown in FIG. 1.

In known manner, the blade 10 in FIG. 1 comprises an airfoil 12, a root 14 formed by a portion of greater thickness extended by a tang 16, and a platform 18 situated between the tang 16 and the airfoil 12. As shown, the blade may also include an outer platform 19 situated in the vicinity of the free end 20 of the blade.

The airfoil 12 forms an aerodynamic surface that extends in a longitudinal direction from the platform 18 to its free end 20. It presents a curved profile of varying thickness made up of a pressure side surface 12*a* and a suction side surface 12*b* connected together transversely by a leading edge 12*c* and a trailing edge 12*d*.

The blade 10 is made of composite material using methods known to the person skilled in the art. The term "composite material" is used herein to mean any material made of fiber reinforcement filled with a matrix, such as for example: ceramic matrix composite (CMC) materials (carbon or ceramic fiber reinforcement filled with a matrix that is made at least in part of ceramic), carbon/carbon (C/C) materials (carbon fiber reinforcement and carbon matrix), oxide/oxide materials (oxide fiber reinforcement and oxide matrix), organic matrix composite (OMC) materials (reinforcement made of glass, carbon, other fibers and organic matrix), etc. reference may be made for example to patent application US 2011/311368, which describes fabricating such a blade comprising fiber reinforcement obtained by three-dimensionally weaving yarns and densified with a matrix. Using such a method, the portion constituting the airfoil 12 is formed integrally with the root 14 of the blade. In the presently-described example, the blade is made of ceramic matrix composite (CMC) material.

Given its particular method of fabrication, the blade 10 also presents, at its root 14, two opposite lateral flanks 22 and 24 that are substantially plane and that are formed respectively extending the pressure side surface 12*a* and the suction side surface 12*b* of the airfoil 12.

Figure 2:
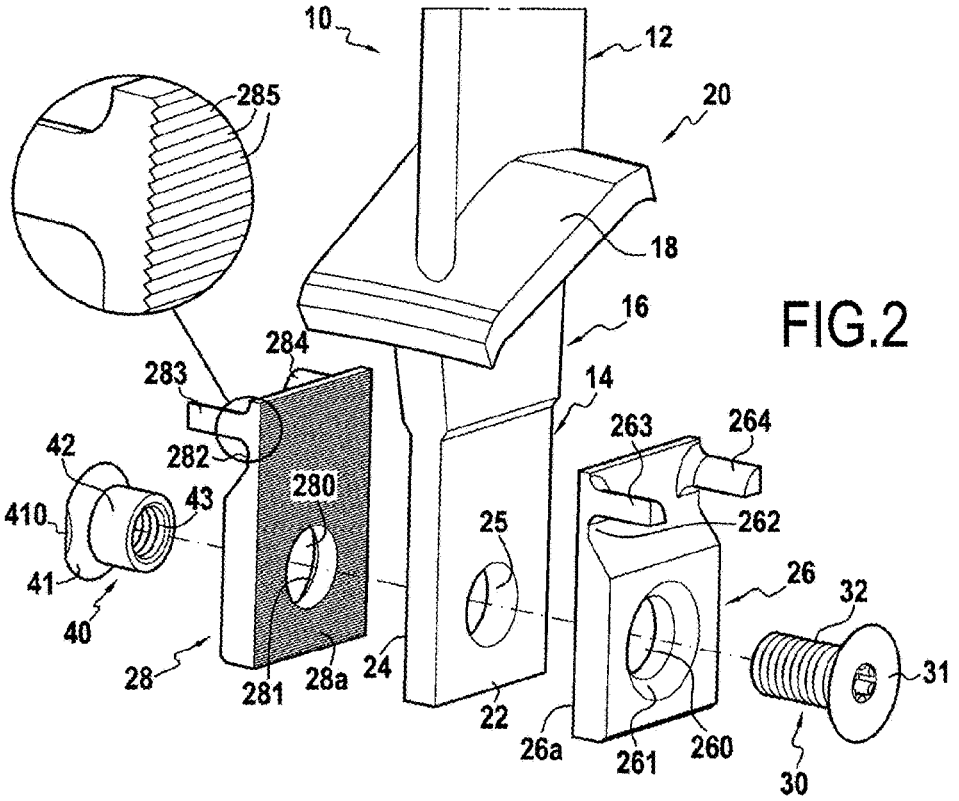
FIGS. 2 and 3 are perspective views showing plates being assembled on the FIG. 1 blade root in an embodiment of the invention.
Figure 3:
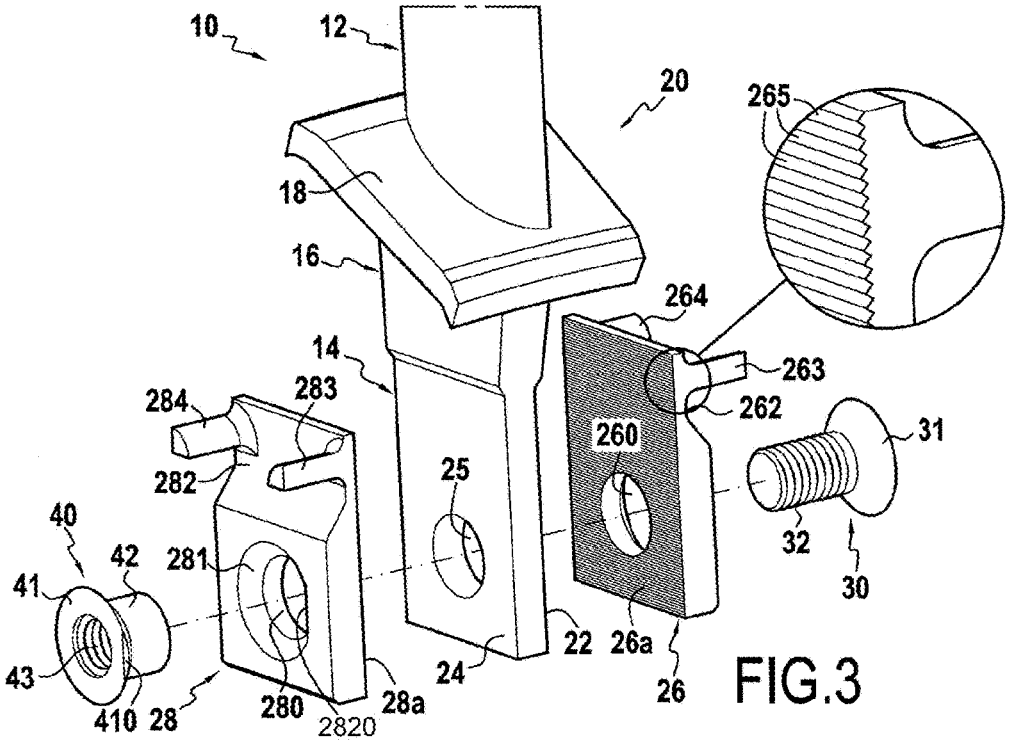
Figure 4:
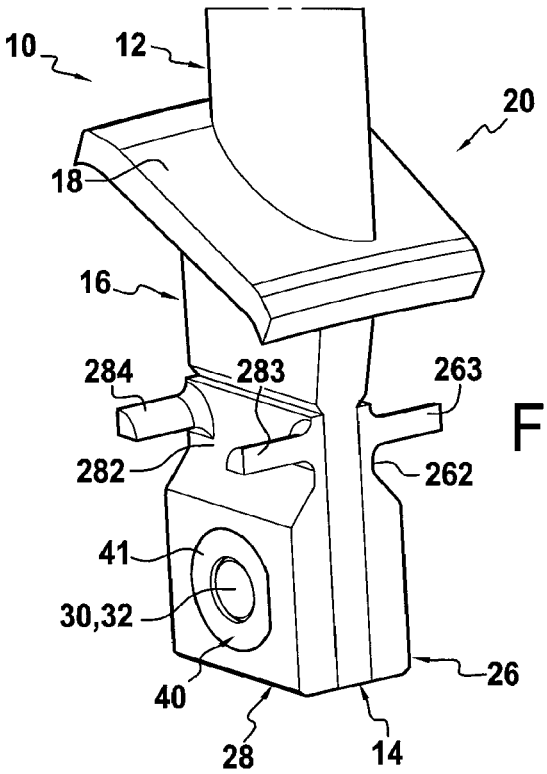
FIG. 4 is a perspective view showing the blade root of FIGS. 2 and 3 once assembled.

In the invention, and as shown in FIGS. 2 to 4, the root 14 of the blade 10 is clamped between two metal plates 26 and 28 that are fastened against respective ones of the lateral flanks 22 and 24 of the root.

The metal plates 26 and 28 are fastened by means of at least one bolt 30 and at least one nut 40 extending in a direction that is substantially perpendicular to the lateral flanks through orifices 260 and 280 that are formed respectively in the plates 26 and 28 and through an orifice 25 formed in the root 14 of the blade. The nut 40 is preferably a self-locking nut. The orifice 25 in the root of the blade is added during the process of fabricating the blade, either by using an insert of corresponding shape during weaving, or else by drilling the root after first infiltration. In the presently-described embodiment, the bolt 30 has a head 31 of frustoconical shape co-operating with a countersink 261 formed in the plate 26, while the nut 40 has a head 41 likewise of frustoconical shape co-operating with a countersink 281 formed in the plate 28. In this way, the screw head and the nut head do not project beyond the outside surfaces of the plates 26 and 28 and they allow the root of the blade to be inserted in housings of small dimensions. The bolt 30 also has a threaded shank 32 that, during tightening of the connection for fastening the plates, co-operates with tapping 43 formed inside a hollow bushing 42 of the nut 40. The head 41 of the nut 40 includes a flap 410 that is for co-operating with a flat 2820 formed in the countersink 281 of the plate 28 so as to prevent the nut 40 turning while it is being tightened with the bolt 30.

In accordance with the invention, the bolt 30 is tightened with the nut 40 by using some minimum level of clamping force that is suitable for ensuring that a centrifugal force or a determined traction force applied to the blade is taken up by friction between the metal plates 26 and 28 and the lateral flanks 22 and 24 of the blade root. The minimum clamping force must make it possible to ensure non-sliding contact between firstly the inside face 26*a* of the metal plate 26 and the flank 22 of the blade root 14, and secondly between the inside face 28*a* of the metal plate 28 and the flank 24 of the blade root 14. Contact between the metal plates and the flanks of the blade root must remain non-sliding in spite of the maximum traction force encountered in operation, which force corresponds to the maximum centrifugal force exerted on the blade while it is in use. The minimum clamping force to be applied to the plates is calculated from the following formula:

$$\text{clamping force} = \frac{\text{centrifugal force applied to the blade}}{\text{coefficient of friction}}$$

By way of example, the bolt may be tightened with a torque wrench that serves to monitor the applied clamping force.

The internal faces 26*a* and 28*a* of the metal plates 26 and 28 respectively facing the flanks 22 and 24 of the blade root 14 may have structured surfaces in order to achieve mechanical anchoring of the metal plates against the flanks of the blade root. In the presently-described example, each of the internal faces 26*a* and 28*a* of the metal plates 26 and 28 includes straight-line knurling 265, 285 oriented perpendicularly to the axis of the blade, and consequently perpendicularly to the direction of the traction force applied to the blade. With such knurling, a coefficient of friction between the plates and the flanks of the blade root is obtained that is close to 1, so the clamping force that needs to be applied is then equal to the maximum centrifugal force. The knurling could equally well be cross-knurling or diamond-knurling. The coefficient of friction between the plates and the flanks of the blade root can also be increased by forming a rough or abrasive layer, such as a layer of brazing, between the metal plates and the flanks of the blade root.

Figure 5:
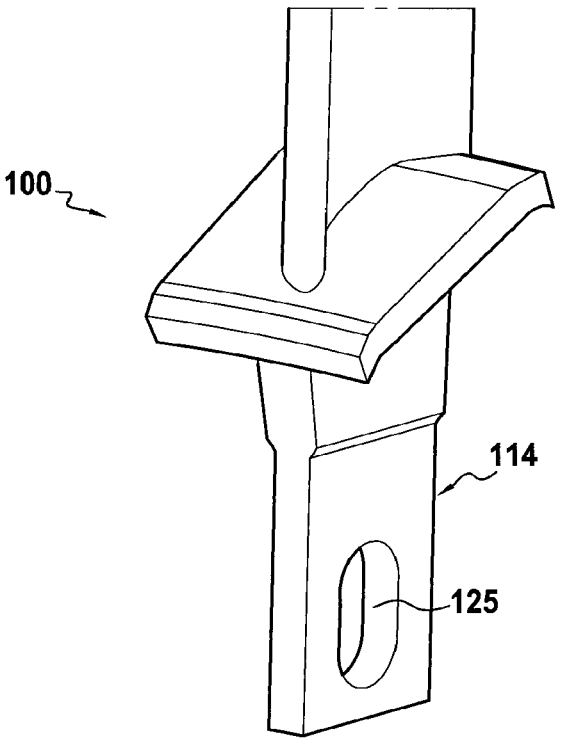
FIG. 5 is a perspective view showing a blade root including an oblong hole in another embodiment of the invention.

In addition, in order to avoid local stresses appearing between the nut-and-bolt connection and the composite material of the blade, and to allow thermomechanical stresses to be released, the orifice for passing the connection that is made through the blade root may be oblong in shape, as shown in FIG. 5, which shows a root 114 of a blade 100 having a through orifice 125 of oblong shape extending in the long direction of the blade 100. The orifice for passing the connection that is made through the blade root could have other suitable shapes, such as festooning.

In order to maintain the clamping force over the entire temperature range that the blade is likely to encounter in operation, a range extending typically from 0° C. to 800° C., the bolt and the nut are made of material presenting a coefficient of thermal expansion that is greater than the coefficient of thermal expansion of the plates so that during temperature rises the nut-and-bolt system expands less than the plates, thus ensuring that the prestress applied to the plates is maintained. As non-limiting examples, the bolt and the nut may be made of a nickel-based high performance alloy of the Haynes® 242® or Waspaloy® type, while the plates may be made of A286 stainless steel or of Inconel® 718.

Figure 6:
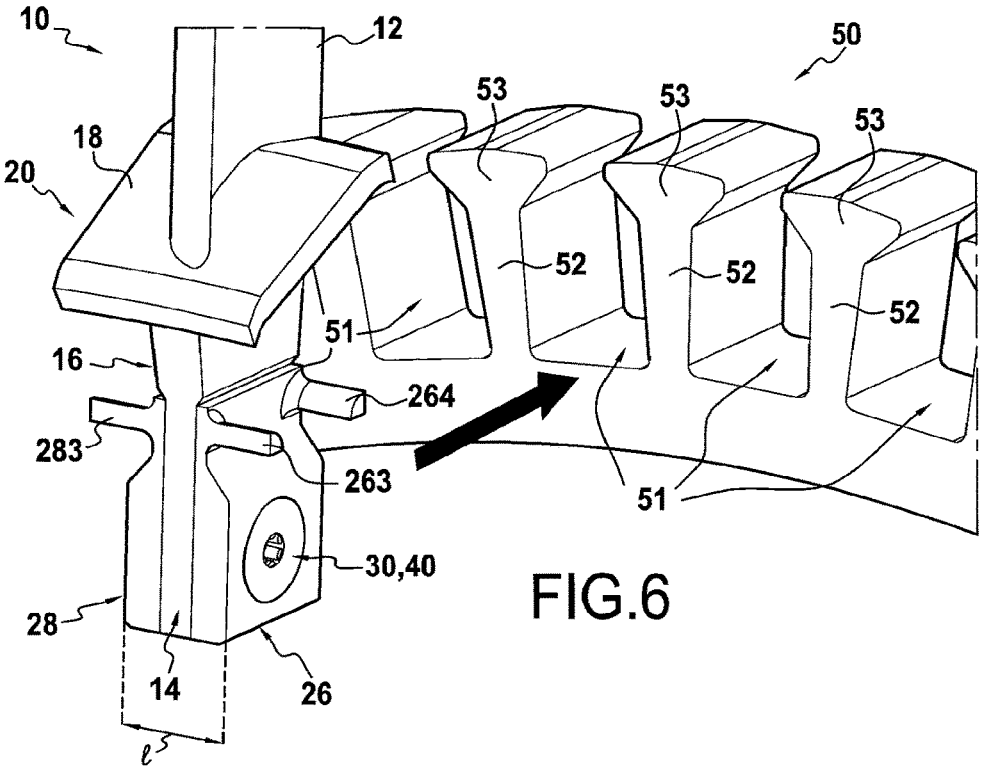
FIG. 6 is a fragmentary perspective view showing the root of a FIG. 4 blade being assembled on a rotor disk.
Figure 7:
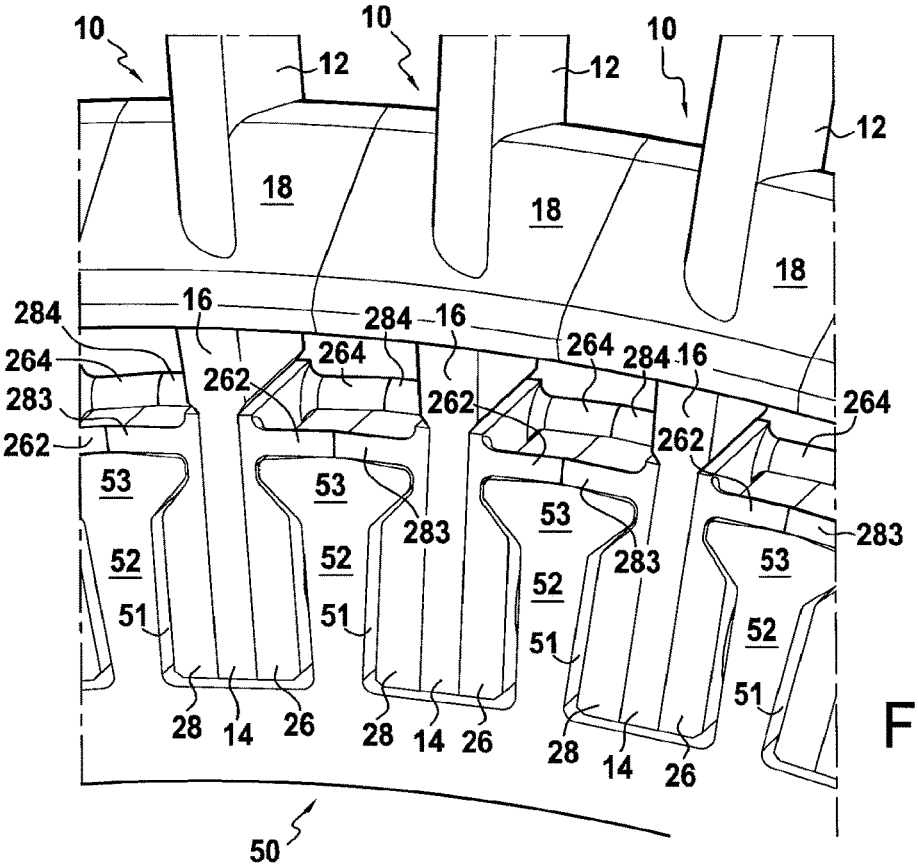
FIG. 7 is a fragmentary perspective view of the FIG. 6 rotor disk fitted with blades of FIG. 4.

Furthermore, the blade, the metal plates, the bolt, and the nut should be made of materials that preferably present coefficients of thermal expansion that vary in similar manner over all or part of the temperature range extending from 0° C. to 800° C. By ensuring that the curves for variation in the coefficients of thermal expansion of all of these elements vary almost correspondingly, clamping strength is better controlled during temperature variations. As non-limiting examples, a blade made of composite material with plates made of A286 stainless steel or of Inconel® 718 and a nut-and-bolt system made of a nickel-based high performance alloy of the Haynes® 242® or Waspaloy® type present coefficients of thermal expansion that vary in identical manner. The metal plates are machined to have a shape that enables the blade root to be given a shape matching the housing in the disk or wheel into which it is to be inserted. In the presently-described example, the plates 26 and 28 are machined so as to form respective portions of smaller thickness 262 and 282, thereby imparting a bulb shape to the blade root once they are assembled thereon, which shape is suitable for co-operating with a housing 51 in a rotor disk 50, as shown in FIGS. 6 and 7. As shown in FIGS. 6 and 7, each blade 10 is assembled on the disk 50 by engaging the root 14 clamped between the plates 26 and 28 in a housing or slot 51. Each housing 51 is separated from an adjacent housing by a tooth 52 having a top portion 53 of enlarged shape for the purpose of retaining the blade during rotation of the disk.

In the presently-described embodiment, the plates 26 have two portions 263 and 264 projecting from the external surface of each plate and extending substantially perpendicularly to that surface. Likewise, each plate 28 has two portions 283 and 284 projecting from the external surface of the plate and extending substantially perpendicularly to that surface. As shown in FIG. 7, the portions 263, 264, 283, and 284 act both as a wall for opposing tilting of the blade, and also to provide a sealing function, with the portions 263 and 264 of one blade coming respectively into contact with the portions 283 and 284 of another blade adjacent thereto.

The use of metal plates enables the blade root to be given a shape that is accurate and reproducible, with this being possible with small dimensions, the root of the above-described low pressure compressor blade typically presenting a width l of about 10 millimeters (mm) (FIG. 6) and needing to be inserted in a housing of equivalent dimensions without clearance.

The invention claimed is:

1. A rotor disk blade for a turbine engine, the blade being made of composite material comprising fiber reinforcement obtained by multilayer weaving of yarns and densified by a matrix, the blade comprising:

a portion constituting an airfoil and a blade root forming a single piece, the blade root having first and second opposite lateral flanks that are formed respectively extending from a pressure side surface and a suction side surface of the airfoil; and first and second metal plates respectively fastened against the first and second lateral flanks of the blade root by a bolt and a nut passing through the first and second metal plates and the blade root so as to clamp the blade root between the first and second metal plates in an assembled state, wherein the bolt has a head bearing against the first metal plate and the nut has a head bearing against the second metal plate, the bolt and the nut applying a minimum clamping force against the first and second metal plates such that a predetermined centrifugal force applied to the blade is taken up by friction between the first and second metal plates and the first and second lateral flanks of the blade root and first faces of the first and second metal plates are respectively in non-sliding contact with the first and second lateral flanks of the blade root, wherein radially inner free ends of the first and second metal plates are aligned with a radially inner free end of the blade root in the assembled state, and wherein radially outer ends of each of the first and second metal plates includes first and second projecting portions extending substantially perpendicularly from second faces of the first and second metal plates, the second faces being opposite of the first faces of the first and second metals plates.

2. A blade according to claim 1, wherein the minimum clamping force is determined by dividing the predetermined centrifugal force with a coefficient of friction between the first and second metal plates and the first and second lateral flanks of the blade root.

3. A blade according to claim 1, wherein the bolt and the nut each presents a head of conical shape, and wherein the first and second metal plates include corresponding countersinks.

4. A blade according to claim 1, wherein the first and second projecting portions of each of the first and second metal plates present a shape suitable for providing one or both of the following functions: opposing tilting and providing sealing.

5. A blade according to claim 1, wherein the blade root includes an oblong hole extending in a longitudinal direction of the blade for passing the bolt and the nut.

6. A blade according to claim 1, wherein the first face of each of the first and second metal plates presents a surface that is structured.

7. A blade according to claim 6, wherein the first face of each of the first and second metal plates includes knurling.

8. A blade according to claim 1, wherein the first and second metal plates have a coefficient of thermal expansion that is less than a coefficient of thermal expansion of the bolt and of the nut.

9. A blade according to claim 1, wherein the blade, the first and second metal plates, the bolt, and the nut present coefficients of thermal expansion that vary over all or part of a temperature range extending from 0° C. to 800° C.

10. A blade according to claim 1, further comprising a platform situated between the blade root and the airfoil, and a tang disposed between the platform and the blade root, a thickness of the tang being greater than a thickness of the blade root in a lateral direction of the blade.

11. A blade according to claim 1, wherein the predetermined centrifugal force is a maximum centrifugal force exerted on the blade during operation of the turbine engine.

12. A blade according to claim 1, wherein the first and second metal plates and the blade root present a bulb shape in the assembled state.

13. A turbine engine rotor disk having a plurality of substantially axial metal slots in an outer periphery thereof, the disk further comprising a plurality of blades according to claim 1, the root of each blade being disposed in a respective slot of the disk.

14. A turbine engine including a low pressure turbine including at least one rotor disk according to claim 13.

15. A turbine engine rotor disk according to claim 13, wherein the first and second projections of the first metal plate of a first blade abut the first and second projections of the second metal plate of a second blade adjacent to the first blade.

16. A method of assembling plates on a blade root, said blade being made of a composite material comprising fiber reinforcement obtained by multilayer weaving of yarns and densified by a matrix, the blade having a portion constituting an airfoil and a blade root forming a single piece, the blade root having first and second opposite lateral flanks that are formed respectively extending from a pressure side surface and a suction side surface of the airfoil, the method comprising:

clamping the blade root between first and second metal plates which are respectively fastened against the first and second lateral flanks of the blade root by tightening a bolt passing through the first and second metal plates and the blade root to a nut, wherein the bolt has a head bearing against the first metal plate, the nut has a head bearing against the second metal plate, wherein during the tightening of the bolt with the nut, a minimum level of clamping force is applied to the first and second metal plates such that a predetermined centrifugal force applied to the blade is taken up by friction between the first and second metal plates and the first and second lateral flanks of the blade root and first faces of the first and second metal plates are respectively in non-sliding contact with the first and second lateral flanks of the blade root, wherein radially inner free ends of the first and second metal plates are aligned with a radially inner free end of the blade root, and wherein radially outer ends of each of the first and second metal plates includes first and second projecting portions extending substantially perpendicularly from second faces of the first and second metal plates, the second faces being opposite of the first faces of the first and second metals plates.

17. A method according to claim 16, wherein the minimum clamping force is determined by dividing the predetermined centrifugal force by a coefficient of friction between the first and second metal plates and the first and second lateral flanks of the blade root.

* * * * *